United States Patent [19]

Witek

[11] Patent Number: 5,038,483

[45] Date of Patent: Aug. 13, 1991

[54] MEASURING GAUGE APPARATUS

[76] Inventor: Brian G. Witek, 5101 N. East River Rd., Chicago, Ill. 60656

[21] Appl. No.: 519,795

[22] Filed: May 7, 1990

[51] Int. Cl.[5] ..... B43L 13/02

[52] U.S. Cl. ..... 33/42

[58] Field of Search ..... 33/41.1, 41.5, 42, 43, 33/44, 34, 35, 40

[56] References Cited

U.S. PATENT DOCUMENTS

| | | | |
|---|---|---|---|
| 848,387 | 3/1907 | Nielsen | 33/41.1 X |
| 1,572,237 | 2/1926 | Hunt | 33/27.03 |
| 1,732,906 | 10/1929 | Morton | 33/42 X |
| 2,296,531 | 9/1942 | McQueen | 33/27.03 |
| 3,293,752 | 12/1966 | Shuman | 33/27.03 |
| 3,543,406 | 12/1970 | Kolb | 33/27.02 |

FOREIGN PATENT DOCUMENTS

| | | | |
|---|---|---|---|
| 2600591 | 12/1987 | France | 33/42 |

*Primary Examiner*—Harry N. Haroian

*Attorney, Agent, or Firm*—Leon Gilden

[57] ABSTRACT

A measuring gauge apparatus includes a elongate sheath containing a longitudinally aligned cavity therewithin slidably receiving a ruler formed with gradations upon its upper surface. The ruler further includes a series of threaded apertures aligned with each gradation. A notch is directed through the forward end of the ruler. Each of the apertures is mounted for receiving a fluid reservoir containing a marking fluid therewithin including a threaded hollow marking shaft coaxially arranged through a bottom surface of the reservoir and including a lid and strap to secure the reservoir to the ruler for marking of an underlying work piece.

6 Claims, 4 Drawing Sheets

PRIOR ART

MEASURING GAUGE APPARATUS

BACKGROUND OF THE INVENTION

1. Field of the Invention

The field of the invention relates to marking gauges, and more particularly pertains to a new and improved measuring gauge apparatus for positioning adjacent a work piece and slidable upon an edge of the work piece to simultaneously impart a marking line to the work piece in use.

2. Description of the Prior Art

The prior art has utilized marking gauges of various types for association with underlieing work pieces. The prior art has heretofore however, failed to produce a single compact organization to tentatively permit marking of an underlieing work piece by use of a freely held marking instrument such as a pencil or alternatively contained a reservoir for selective marking of a work piece at a preselected interval.

Examples of the prior art include U.S. Pat. No. 732,739 to SHIREMAN illustrating the use of a carpenters gauge wherein a generally T-shaped gauge is provided with a set of indicia along a measuring lengh of the gauge with openings aligned with the indicia as well as an offset row of openings for indication of measuring underlying the gauge through selective lines of the openings.

U.S. Pat. No. 1,257,683 to DEFENBAUGH illustrates an L-shaped gauge including a slot along a measuring leg to accept a pencil or marking instrument for marking underlying work piece relative to a selective line of the indicia.

U.S. Pat. No. 4,503,624 to WHITEFORD illustrates a carpenters square wherein elongate blade includes opposed measuring scales and elongate apertures formed along each of the lines of the measuring square to facilitate use of the squares as a scribing tool.

U.S. Pat. No. 4,700,489 to VASILE sets forth the use of a square leveling tool including a taphead measure, a level, a steady indicator packaged in a single unit.

As such, it may be appreciated that there continues to be a need for a new and improved measuring gauge apparatus as set forth by the instant invention wherein the same addresses both the problems of ease of use as well as affectiveness in construction and in this respect, the present invention substantially fulfills this need.

SUMMARY OF THE INVENTION

In view of the foregoing disadvantages inherent in the known types of measuring gauge structures now present in the prior art, the present invention provides and improved measuring gauge apparatus wherein the same permits scribing as well as mounting of a scribing unit to the gauge to permit selective measuring of a work piece positioned thereunder. As such, the general purpose of the present invention, which will be described subsequently in greater detail, is to provide a new and improved measuring gauge apparatus which has all the advantages of the prior art measuring gauge apparatus and none of the disadvantages.

To attain this, the measuring gauge apparatus of the instant invention essentially includes a measuring gauge apparatus includes a elongate sheath containing a longitudinally aligned cavity therewithin slidably receiving a ruler formed with gradations upon its upper surface.

The ruler further includes a series of threaded apertures aligned with each gradation with a notch directed through a forward end of the ruler. Each of the apertures is mounted for receiving a fluid reservoir containing a marking fluid therewithin including a threaded hollow marking shaft coaxially arranged through a bottom surface of the reservoir and including a lid and strap to secure the reservoir to the ruler for marking of an underlying work piece.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and specially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved measuring gauge apparatus which has all the advantages of the prior art measuring gauge apparatus and none of the disadvantages.

It is another object of the present invention to provide a new and improved measuring gauge apparatus which may be easily and efficiently manufactured and marketed.

It is a further object of the present invention to provide a new and improved measuring gauge apparatus which is of a durable and reliable construction.

An ever further object of the present invention is to provide a new and improved measuring gauge apparatus which is susceptible of a low cost of manufacture with regard to both materials and labor, and which accordingly is then susceptible of low prices of sale to be the consuming public, thereby making such measuring gauge apparatuses economically available to the buying public.

Still yet another object of the present invention is to provide a new and improved measuring gauge apparatus which provides in the apparatuses and methods of the prior art some of the advantages thereof, while simultaneously overcoming some of the disadvantages normally associated therewith.

Still another object of the present invention is to provide a new and improved measuring gauge apparatus which may be compactly stored when not being utilized.

Yet another object of the present invention is to provide a new and improved measuring gauge apparatus utilizing a telescoping rule mounted within a sheath to permit sliding of the gauge along a side of an underlying workpiece to permit marking of an elongate line parallel to the aforenoted side.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
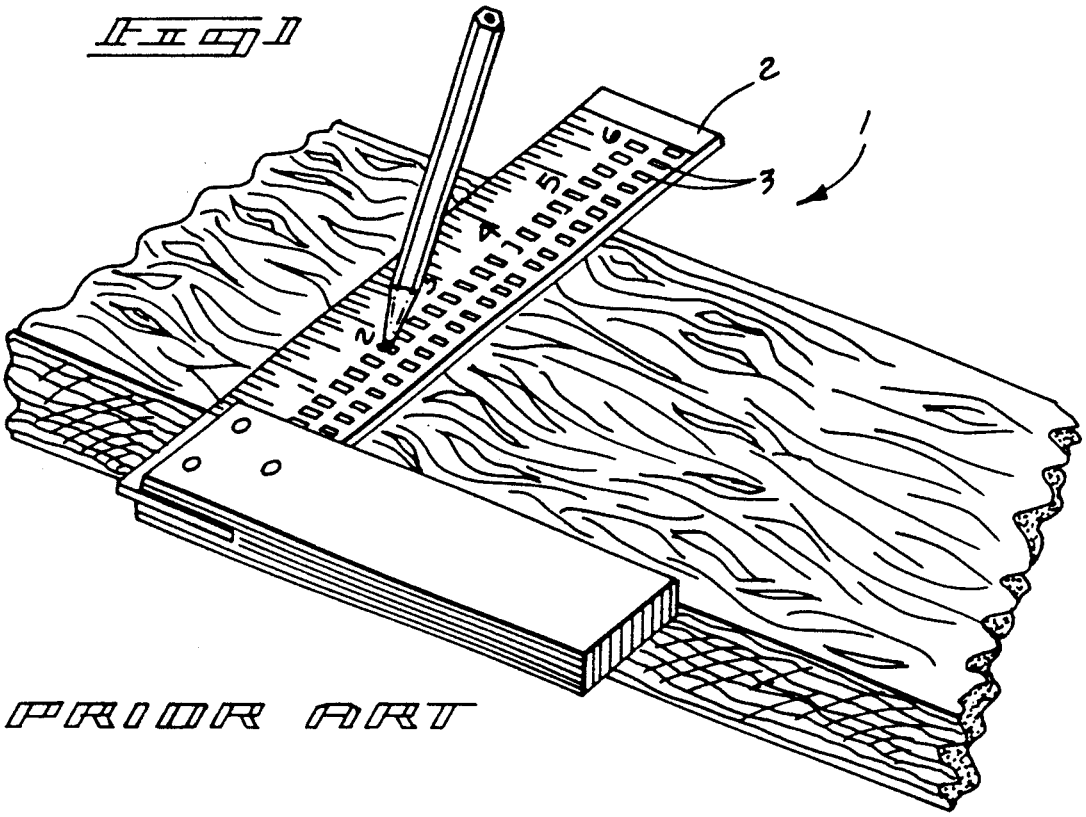
FIG. 1 is an isometric illustration of a prior art measuring gauge apparatus.

With reference now to the drawings, and in particular to FIGS. 1 to 8 thereof, a new and improved measuring gauge apparatus embodying the principles and concepts of the present invention and generally designated by the reference numeral 10 will be described.

Figure 2:
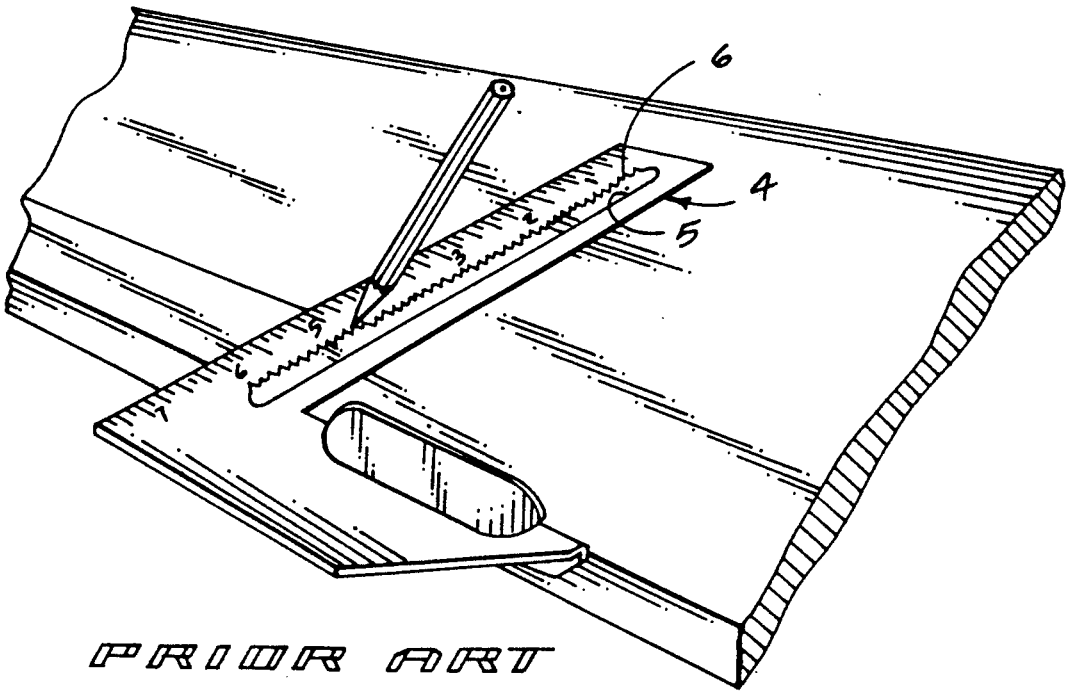
PRIOR ART Fig 2
FIG. 2 is an isometric illustration of a further prior art measuring gauge apparatus.

FIG. 1 illustrates a prior art measuring gauge of a generally L-shaped configuration utilizing a rule member 2 provided with indicia therealong and openings aligned with the indicia wherein the openings 3 are positioned for marking by use of a writing instrument a work piece underlying the rule. FIG. 2 illustrates a generally L-shaped marking rule wherein the rule member 4 includes an elongate series of measuring indicia wherein a slot 5 and a serrated edge are aligned with the slot to permit marking of a underlying work piece.

More specifically, the measuring gauge apparatus 10 of the instant invention essentially comprises a tubular rigid sheath 11 including a through extending elongate cavity 12 directed therethrough defined by a generally parallelpiped configuration. The sheath 11 includes a planar U-shaped abutment plate 13 orthogonally mounted to a forward terminal end 15 of the sheath wherein the abutment plate 13 extends below and laterally and vertically relative to the sheath to provide an abutment surface positionable against a forward surface of the plate in use with a work piece. The plate includes a generally U-shaped slot directed upwardly of the terminal end 15 to permit reciprocation of an associated elongate ruler 16 relative to the sheath and associated cavity 12 that the rule 16 slidably fits within. The rule 16 is of a generally rectangular parallelepiped configuration complimentary to that of the cavity 12. The U-shaped slot 14 permits enhanced visual observation of the ruler in use as well as ease of manual manipulation of the ruler relative to the sheath 15.

Figure 3:
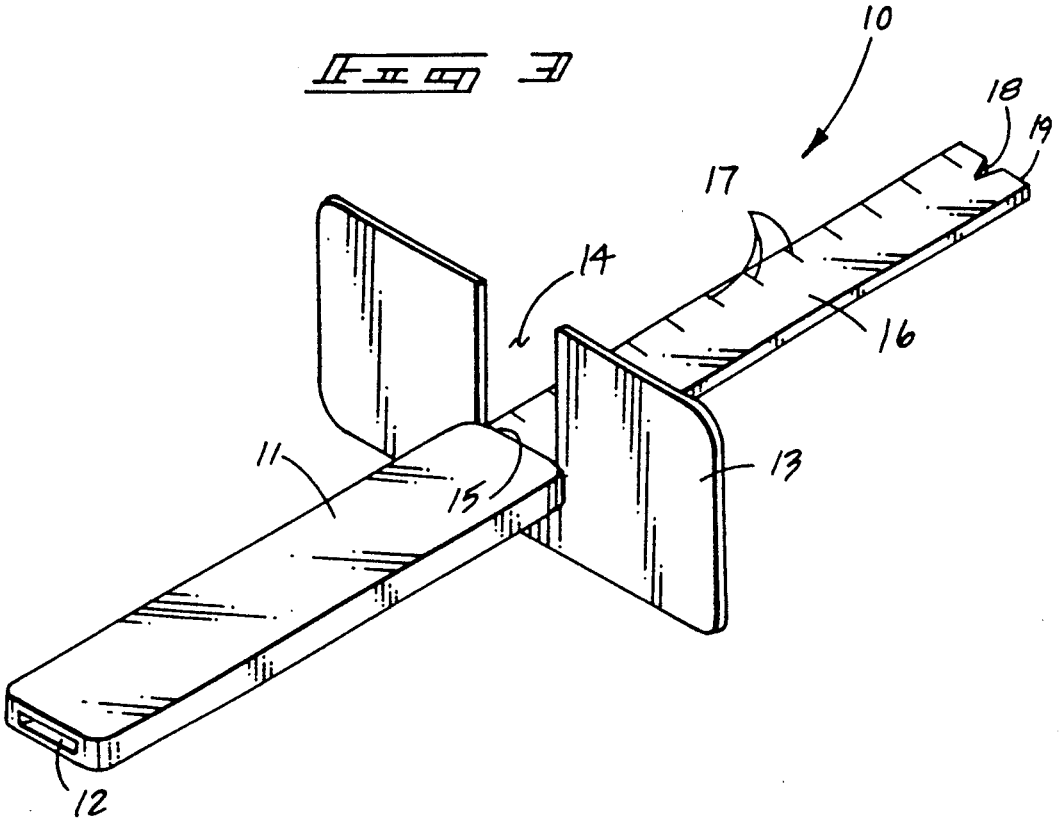
FIG. 3 is an isometric illustration of the instant invention.
Figure 4:
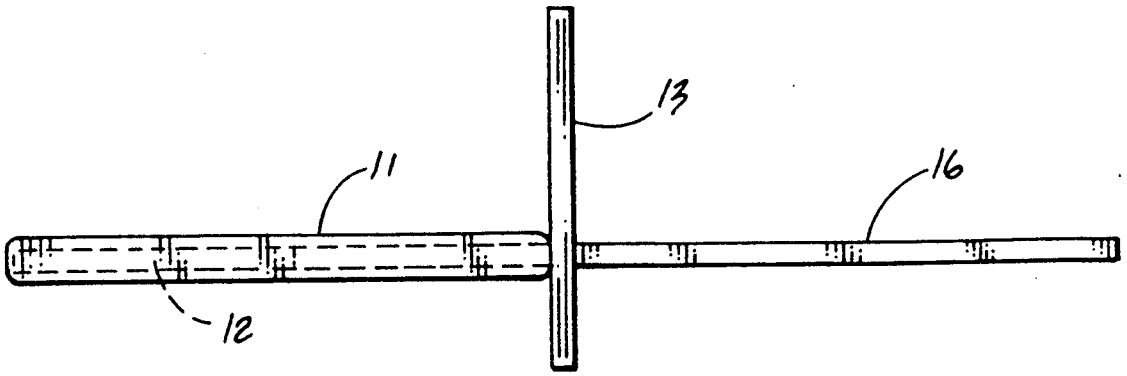
FIG. 4 is an orthographic side view taken in elevation of the instant invention.

The ruler 16 includes an elongate series of spaced gradations 17 of conventional measurements such as inches, millimeters, and the like. A V-shaped notch 18 is mounted medially and orthogonally into a forward terminal end 19 of the ruler 16 as illustrated in FIG. 3.

Figure 5:
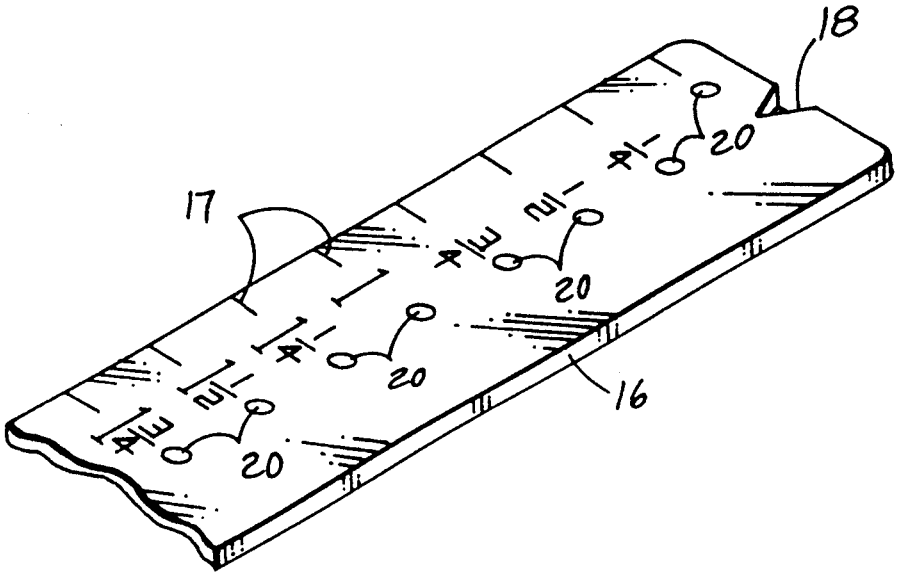
FIG. 5 is an isometric illustration, partially in section, of the rule utilized by the instant invention.
Figure 6:
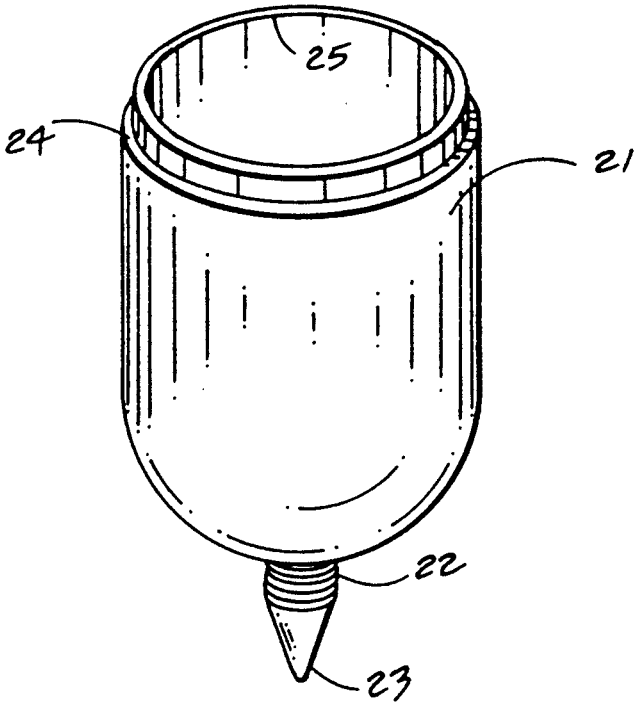
FIG. 6 is an isometric illustration of the marking fluid container utilized by the instant invention.
Figure 7:
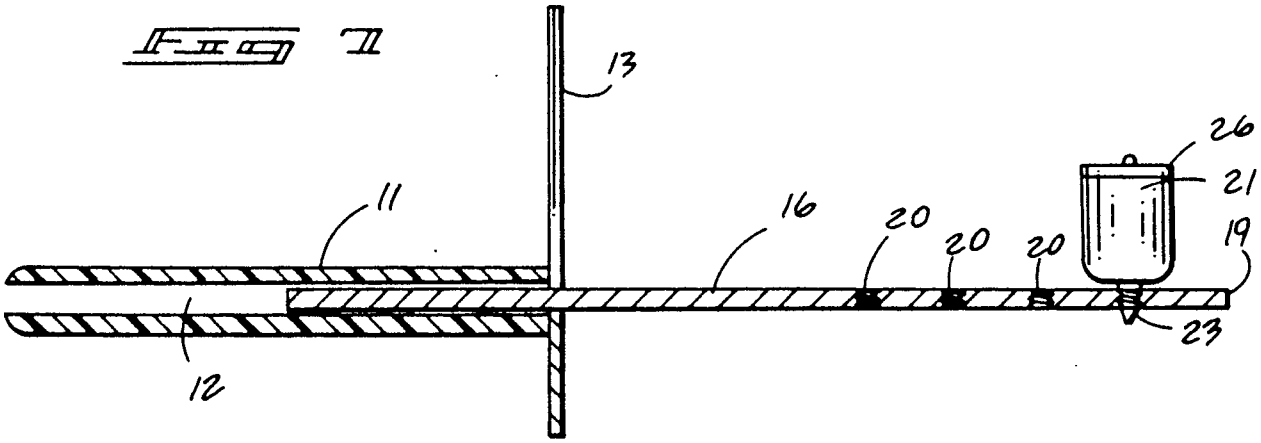
FIG. 7 is an orthographic side view taken in elevation of the instant invention in association with the fluid marking reservoir utilized by the instant invention.
Figure 8:
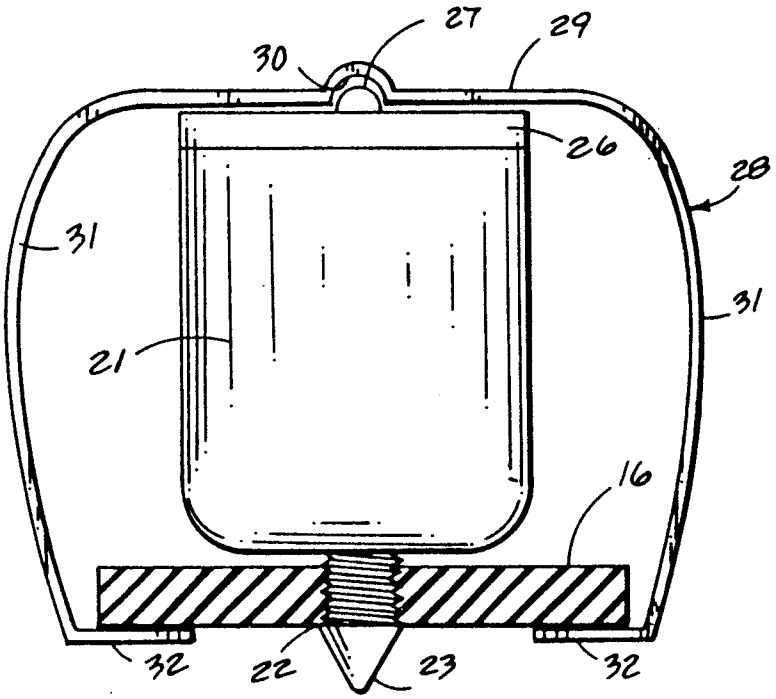
FIG. 8 is an orthographic cross-sectional view of the fluid marking reservoir in securement to the rule of the instant invention.

Further, FIG. 5 illustrates the gradations 17 including through extending internally threaded apertures 20 aligned with each of the gradations 17 and spaced at the aforenoted intervals of the gradations 17 to permit selectively introduction of a writing instrument through the apertures 20 for marking of an aligned work piece at a preselected aperture or selectively threadedly receiving a reservoir container 21 that includes a hollow externally threaded shaft 22 coaxially and medially mounted to a bottom surface of the reservoir 21 wherein the threads 22 are complementarily formed to those of the apertures 20. Further, the threaded shaft 22 is of a thickness substantially equal to the thickness of the ruler 16 to permit only an ink directing conical marking tip 23 to extend below a bottom surface of the ruler 16 in a marking procedure as illustrated in FIG. 8 for example.

The reservoir 21 is further formed with an annular ledge 24 adjacent an upper annular rim 25 wherein the annular ledge 24 receives a lid 26 thereon. The lid as illustrated in FIG. 8 for example includes a projection 27 coaxially and upwardly projecting from an upper surface of the lid 26. FIG. 8 illustrates the use of a generally U-shaped spring clip 28 for use in association with the reservoir organization 21 wherein the clip includes a top leg 29 formed with a central coaxially aligned recess 30 to receive the projection 27 therewithin to align the reservoir and associated lid relative to the clip. The clip includes downwardly depending side legs 31 directed from an upper surface of the lid 26 to a bottom surface of the ruler 16 with bottom legs 32 directed inwardly in an underlying relationship relative to a bottom surface of the ruler 16 and aligned relative to one another to maintain alignment and securement of the reservoir in use.

The instrument may adquididly be positioned adjacent a work piece in a manner as illustrated in FIGS. 1 or 2 with the ruler extended in a predetermined orientation. The instrument or apparatus 10 is slidedly directed along an upper surface of the work piece. A writing instrument mounted within the V-shaped notch 18 or selectively by the reservoir and associated marking tip 23, imparts an indicator line along an upper surface of the work piece for subsequent treatment to the work piece.

As to the manner of usage and operation of the instant invention, the same should be apparent from the above disclosure and accordingly to further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modifications and equivalents may be resorted to , falling within the scope of the invention.

I claim:

1. A measuring gauge apparatus comprising, in combination, an elongate sheath defining a predetermined length and including a longitudinally aligned cavity directed therethrough coextensive the predetermined length, and an elongate ruler defined by a ruler length greater than the predetermined length including spaced gradations indicated at predetermined spaced intervals on an upper surface of the ruler, and the ruler including a forward terminal end and a rear terminal end, and wherein the forward terminal end includes a "V" shaped notch directed orthogonally and medially and interiorly of the ruler originating at the forward terminal end, and further including a series of threaded apertures directed orthogonally through the ruler aligned with and adjacent each of the gradations and further including a reservoir including a threaded shank orthogonally & coaxially mounted to a bottom surface of the reservoir wherein the threaded shank is selectively receivable within one of the threaded apertures.

2. Apparatus set forth in claim 1 wherein the sheath includes a forward terminal end, and including a generally U-shaped end plate orthogonally and integrally mounted to the forward terminal end of the sheath, the abutment plate extending laterally beyond and vertically above and below the forward terminal end and further including a U-shaped slot aligned with and directed orthogonally upwardly of the forward terminal end of the sheath to measurably enhance observation of the ruler and ease manual manipulation thereof relative to the sheath.

3. Apparatus set forth in claim 2 wherein the cavity is defined by a rectangular parallelepiped configuration and wherein the ruler is defined by a cross-sectional configuration equal to the parallelepiped configuration to be complimentarily received within the cavity.

4. Apparatus set forth in claim 3 wherein the reservoir further includes a conical marking tip coaxially aligned with and integrally mounted to a lower terminal end of the threaded shaft, the threaded shaft defined by a predetermined length, the predetermined length equal to a predetermined width defined by a thickness of the ruler to permit an extending of the marking tip only below a bottom surface of the ruler in securement of the reservoir to the ruler.

5. Apparatus set forth in claim 4 wherein the reservoir includes a lid, and an upper end of the reservoir includes a ledge, the lid complimentarily received within the ledge, the lid further including a projection coaxially projecting above an upper surface of the lid, and a clip overlying the projection to secure the lid and the reservoir to the ruler.

6. Apparatus set forth in claim 5 wherein the clip includes spaced side legs and a central top leg integrally mounted to upper terminal ends of the side legs, the side legs projecting downwardly along diametrically opposed sides of the reservoir and the side legs directed downwardly positioned aligned with a bottom surface of the ruler, and bottom legs directed interiorly of the ruler to underlie the bottom surface of the ruler to secure and stabilize the reservoir relative to the ruler.

* * * * *